US011178975B2

(12) United States Patent
Durden

(10) Patent No.: US 11,178,975 B2
(45) Date of Patent: Nov. 23, 2021

(54) PILLOW LIFTING SYSTEM

(71) Applicant: Allan Fitzgerald Durden, La Mesa, CA (US)

(72) Inventor: Allan Fitzgerald Durden, La Mesa, CA (US)

( * ) Notice: Subject to any disclaimer, the term of this patent is extended or adjusted under 35 U.S.C. 154(b) by 0 days.

(21) Appl. No.: 16/269,004

(22) Filed: Feb. 6, 2019

(65) Prior Publication Data

US 2019/0200775 A1 Jul. 4, 2019

Related U.S. Application Data

(63) Continuation of application No. PCT/US2017/047420, filed on Aug. 17, 2017.

(60) Provisional application No. 62/376,282, filed on Aug. 17, 2016.

(51) Int. Cl.
*A47C 20/04* (2006.01)
*A61G 7/005* (2006.01)
(Continued)

(52) U.S. Cl.
CPC ..... *A47C 20/048* (2013.01); *A47C 7/624* (2018.08); *A47C 31/008* (2013.01); *A61G 7/005* (2013.01);
(Continued)

(58) Field of Classification Search
CPC ..... A47C 20/027; A47C 20/048; A47C 1/14; A47C 1/143; A47C 1/146; A47C 1/02; A47C 1/102; A47C 1/03; A47C 1/0308; A47C 20/023; A47C 20/04; A47C 20/041; A47C 20/042; A47C 20/043; A47C 20/045; A47C 20/046; A47C 20/047; A47C 20/08; A47C 20/10; A47C 20/12; A47C 20/14; A47C 20/16; A47C 20/18; A47C 7/407; A47C 7/54; A47C 1/0242; A47C 1/0244; A47C 7/624; A61G 7/07; A61G 7/005; A61G 2200/327; A61G 2200/34
(Continued)

(56) References Cited

U.S. PATENT DOCUMENTS 2,666,216 A * 1/1954 Schnaitter ..... A47C 20/027 5/660
3,931,653 A * 1/1976 Bien ..... A47C 20/027 5/634
(Continued)

FOREIGN PATENT DOCUMENTS

GB 2257032 A * 1/1993 ..... A61G 5/125

OTHER PUBLICATIONS

International Search Report and Written Opinion dated Oct. 27, 2017 for related International Application No. PCT/US2017/047420, in 11 pages.

*Primary Examiner* — Eric J Kurilla
*Assistant Examiner* — Amanda L Bailey
(74) *Attorney, Agent, or Firm* — Procopio, Cory, Hargreaves & Savitch LLP

(57) ABSTRACT

An apparatus for used to lift the torso of a human from a supine position to a sitting position. This is a lightweight apparatus which can be easily carried and placed on a bed or other flat surface. It is placed under the torso of the subject and includes a base, back rest and actuator. The back rest is pivotally coupled to the base and the actuator is used to rotate the back rest from a flat lying position to a vertical sitting position.

15 Claims, 5 Drawing Sheets

(51) Int. Cl.
*A61G 7/07* (2006.01)
*A47C 7/62* (2006.01)
*A47C 31/00* (2006.01)

(52) U.S. Cl.
CPC ..... *A61G 7/07* (2013.01); *A61G 2200/327* (2013.01); *A61G 2200/34* (2013.01)

(58) Field of Classification Search
USPC ..... D6/367, 379, 368
See application file for complete search history.

(56) References Cited

U.S. PATENT DOCUMENTS

| | | | | | |
|---|---|---|---|---|---|
| 4,660,237 | A * | 4/1987 | Brodnax | A47C 7/383 | 297/377 |
| 5,425,567 | A * | 6/1995 | Albecker, III | A47C 1/146 | 297/377 |
| 5,463,784 | A * | 11/1995 | Alpern | A47C 21/08 | 5/426 |
| 5,937,459 | A | 8/1999 | Binaghi et al. | | |
| 6,008,598 | A * | 12/1999 | Luff | A47C 31/008 | 318/16 |
| 7,028,353 | B2 * | 4/2006 | Waldman | A47C 21/08 | 5/426 |
| 7,240,385 | B1 * | 7/2007 | Brown | A47C 20/022 | 5/617 |
| D846,926 | S * | 4/2019 | Hairabedian | D6/708.16 | |
| 2006/0061148 | A1 | 3/2006 | Pollard et al. | | |
| 2006/0186721 | A1 | 8/2006 | Flory et al. | | |
| 2012/0193946 | A1 | 8/2012 | Robertson | | |
| 2014/0265497 | A1 | 9/2014 | Hough et al. | | |
| 2017/0239113 | A1 * | 8/2017 | Harburg | A61G 7/0755 | |

* cited by examiner

PILLOW LIFTING SYSTEM

CROSS-REFERENCE TO RELATED APPLICATIONS

The present application is a continuation of International Application No. PCT/US2017/047420, filed on Aug. 17, 2017, which claims the benefit of U.S. Provisional Patent Application No. 62/376,282, filed on Aug. 17, 2016, all of which are incorporated herein by reference in their entirety.

BACKGROUND

Many people lying down struggle to sit up. This may be due to a permanent condition or to a temporary condition, such as recovery from a medical procedure. Since mattress elevators are expensive and difficult to move they might not be affordable or practical for most people that need help sitting up. This torso lifting system referred to herein as a pillow lifting system is a lightweight and less expensive apparatus that can be used to help people sit up from a lying position. This apparatus lifts the torso of the human so that a sitting position can be achieved.

DETAILED DESCRIPTION

The system disclosed herein includes a torso lifting apparatus referred to herein as a pillow lifting system which assists a person in a supine position to elevate into a sitting position, this apparatus elevates the torso of the person. This is a lightweight apparatus which can be easily moved from one location to another. It is designed to be placed on a bed or other flat surface under the torso of the person who is using it. The weight of this apparatus can range from five to twenty two pounds depending on the material it is manufactured with. Preferred manufacture materials are disclosed below.

In one embodiment, the pillow lifting system includes a base, a back rest pivotally coupled to the base and an actuator coupled to the base and to the back rest. The actuator is operable to rotate the back rest from a flat lying position (horizontal position) to a vertical sitting position and may set the back rest to any position there between. The back rest has a large range of motion and can move from a flat position to a completely folded position for storage or transport. As such the angle between the base and the back rest can range from 0 degrees to 180 degrees. The pillow lifting system may be placed on a bed or other flat surface and used by an individual with difficulties sitting up from a lying position, such as an individual who is bed ridden or recovering from surgery. In embodiments, the pillow lifting system also includes leg assemblies that form a hook like shape with the base. The hook like shape of the base may hook to the end of the mattress and holds the pillow lifting system in place connected to the mattress or other flat surface.

Figure 1:
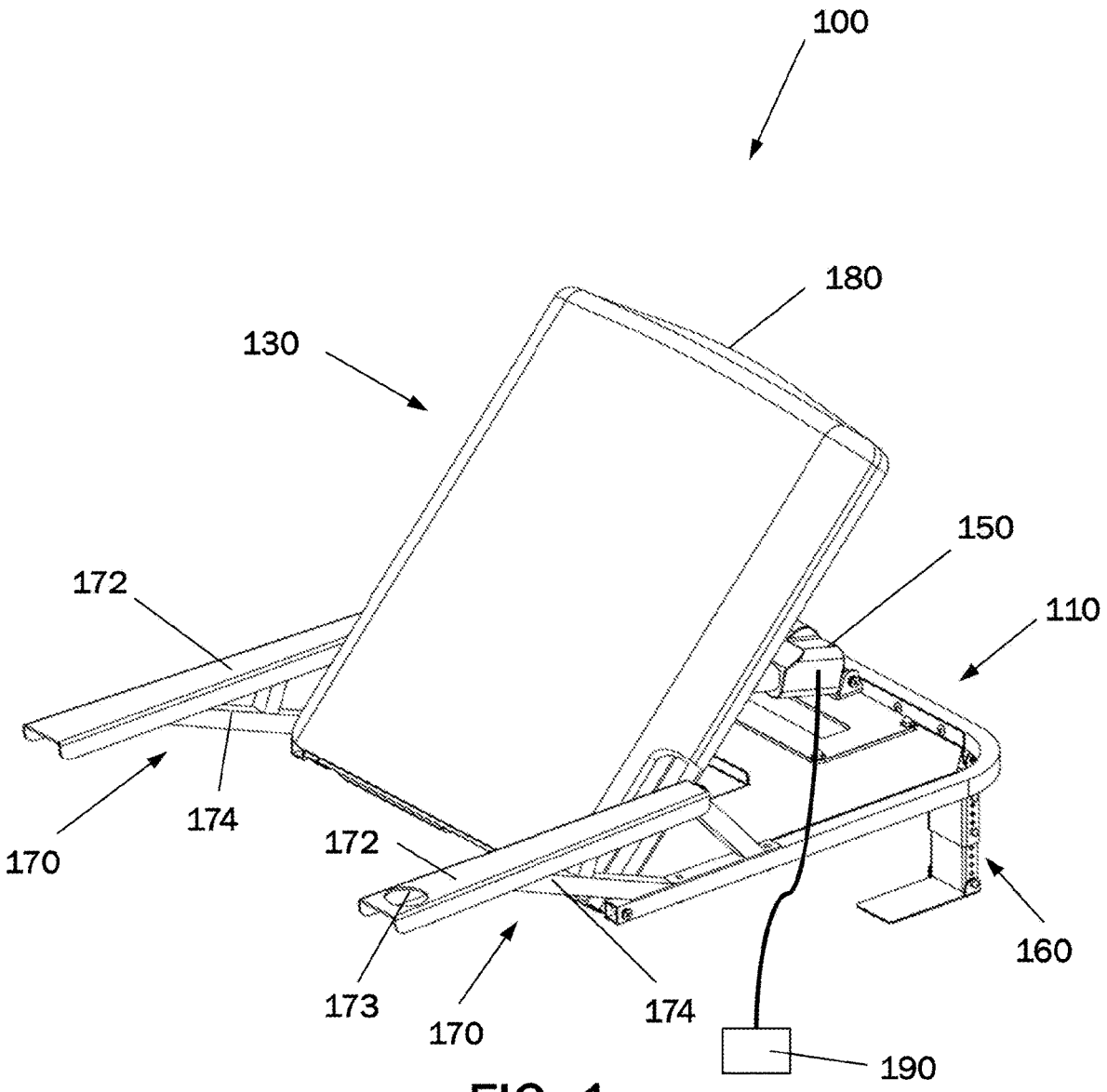
FIG. 1 is a perspective view of an embodiment of the pillow lifting system.

FIG. 1 is a perspective view of an embodiment of the pillow lifting system 100. Referring to FIG. 1, the pillow lifting system 100 includes a base 110, a back rest 130, and an actuator 150. The base 110 and the back rest 130 may be joined at one end. The joint between the base 110 and the back rest 130 permits the back rest 130 to rotate relative to the base 110. The actuator 150 connects to the base 110 and the back rest 130. The actuator 150 is configured to control the rotation of the back rest 130 relative to the base 110.

Figure 2:
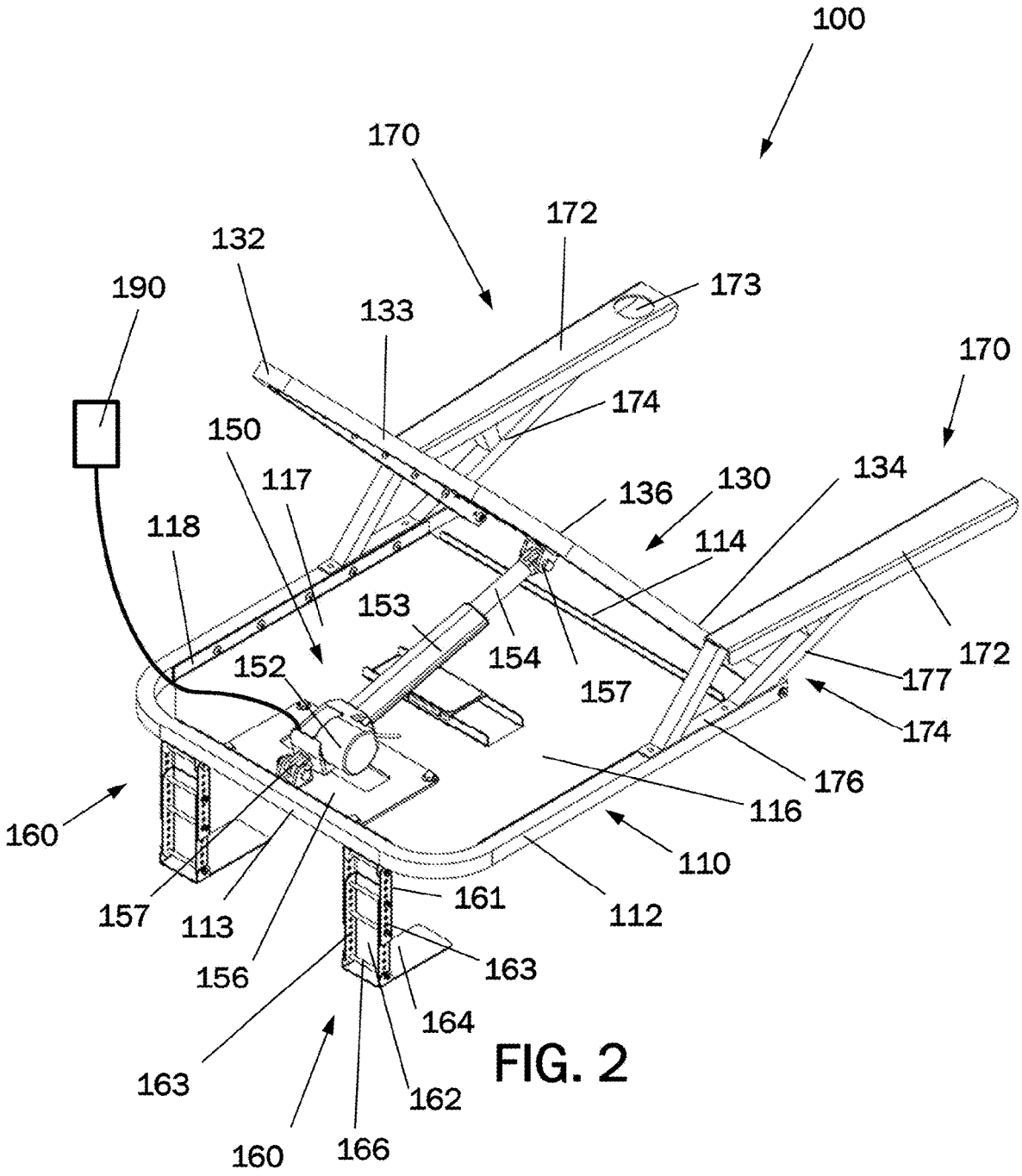
FIG. 2 is a perspective view of the pillow lifting system of FIG. 1 from a different viewpoint.

The pillow lifting system 100 may also include a leg assembly 160, an arm rest assembly 170, and a pillow 180. The leg assembly 160 may be joined to the base 110 at an end opposite and distal to the connection location of the base 110 to the back rest 130. As shown in FIG. 2, the pillow lifting system 100 may include more than one leg assembly 160. In the embodiment illustrated, the pillow lifting system 100 includes two leg assemblies 160. However, any number of leg assemblies 160, such as one, three, or more leg assemblies 160 may be used.

The arm rest assembly 170 may also be joined to the base 110. The arm rest assembly 170 may be joined to the base using fasteners, such as thumb screws. Easily removable fasteners, such as thumb screws, may allow the arm rest assembly 170 to be removed without a tool. The arm rest assembly 170 may be located adjacent the back rest 130 and may be joined to the base 110 at the same end as the back rest 130. In the embodiment illustrated, the pillow lifting system 100 includes two arm rest assemblies 170. However, some embodiments may only include one arm rest assembly 170.

The pillow 180 may cover all or a portion of the back rest 130.

FIG. 2 is a perspective view of the pillow lifting system 100 of FIG. 1 looking at a rear birds eye view of the apparatus. The view in FIG. 2 is shown without the pillow 180 for clarity. Referring to FIG. 2, the base 110 may include a bottom frame 112 and a bottom plate 116. The bottom frame 112 may generally have a 'U' shape and may include a closed end 113 and an open end 114. The bottom frame 112 may be a tube, such as an aluminum tube. In the embodiment illustrated, the bottom frame 112 is a rectangular tube.

The bottom plate 116 is joined to the bottom frame 112 and may not extend completely to the open end 114. In the embodiment illustrated, the bottom plate 116 includes a bottom plate portion 117 and bottom brackets 118. The bottom plate portion 117 may be a metal plate, such as an aluminum plate, the plate could also be manufactured from plastic or mesh material, located within the bottom frame 112. The bottom brackets 118 extend from the bottom plate 116 and are joined, such as by fastening, to the bottom frame 112. The bottom brackets 118 may be a portion of the bottom plate 116 that is bent approximately perpendicular to the remainder of the bottom plate 116, which allows for the bottom brackets 118 to be easily joined to the bottom frame 112.

The back rest 130 may include a front frame 132 and a front plate 136. The front frame 132 may have a 'U' shape with a closed end 133 and an open end 134. The front frame 132 may be a tube, such as an aluminum tube. In the embodiment illustrated, the front frame 132 is a rectangular tube. In the embodiment illustrated, the front frame 132 is narrower than the bottom frame 112 to allow the open ends to be easily joined and pivotally connected with the front frame open end 134 located within and adjacent to the bottom frame open end 114.

The front plate 136 is joined to the front frame 132. Similar to the bottom plate 116, the front plate 136 may include a front plate portion and front brackets. The front plate portion and the front brackets may be the same as or similar to the bottom plate portion 117 and the bottom brackets 118.

Figure 3:
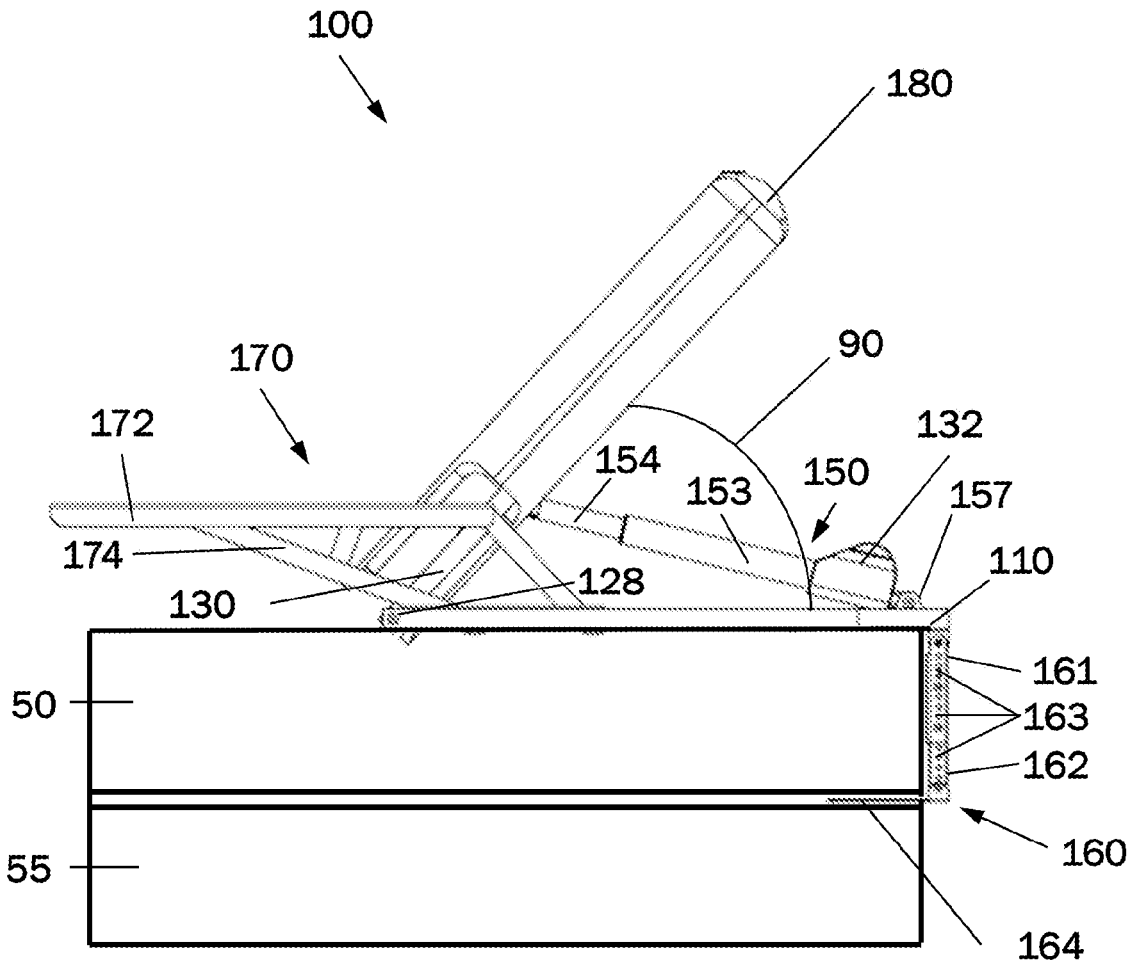
FIG. 3 is a side view of the pillow lifting system of FIG. 1 installed on a mattress.

FIG. 3 is a side view of the pillow lifting system 100 of FIG. 1 installed on a mattress 50. Referring to FIGS. 2 and 3, the actuator 150 may be a linear actuator, such as a hydraulic cylinder, and may include a motor 152, a cylinder 153, and a rod 154. The motor 152 moves the rod 154 relative to the cylinder 153 to lengthen or shorten the actuator 150 causing the back rest 130 to rotate relative to the base 110 at a pivot point 128 located at the joint between the back rest 130 and the base 110.

The base 110 and the back rest 130 may each include a mounting plate 156 and a mounting bracket 157. The mounting plate 156 for the base 110 may be joined to the bottom plate 116 adjacent the closed end 113 of the bottom frame 112. The mounting plate 156 for the back rest 130 may be joined to the front plate 136 adjacent to the closed end 133 of the front frame 132. Each mounting bracket 157 may be joined to a mounting plate 156. Each end of the actuator 150 may be pivotally connected to a mounting bracket 157. The motor 152 may be connected to a mounting bracket 157 and the rod 154 may be connected to a mounting bracket 157. In the embodiment illustrated, the motor 152 is connected to the base 110 and the rod 154 is connected to the back rest 130.

Figure 4:
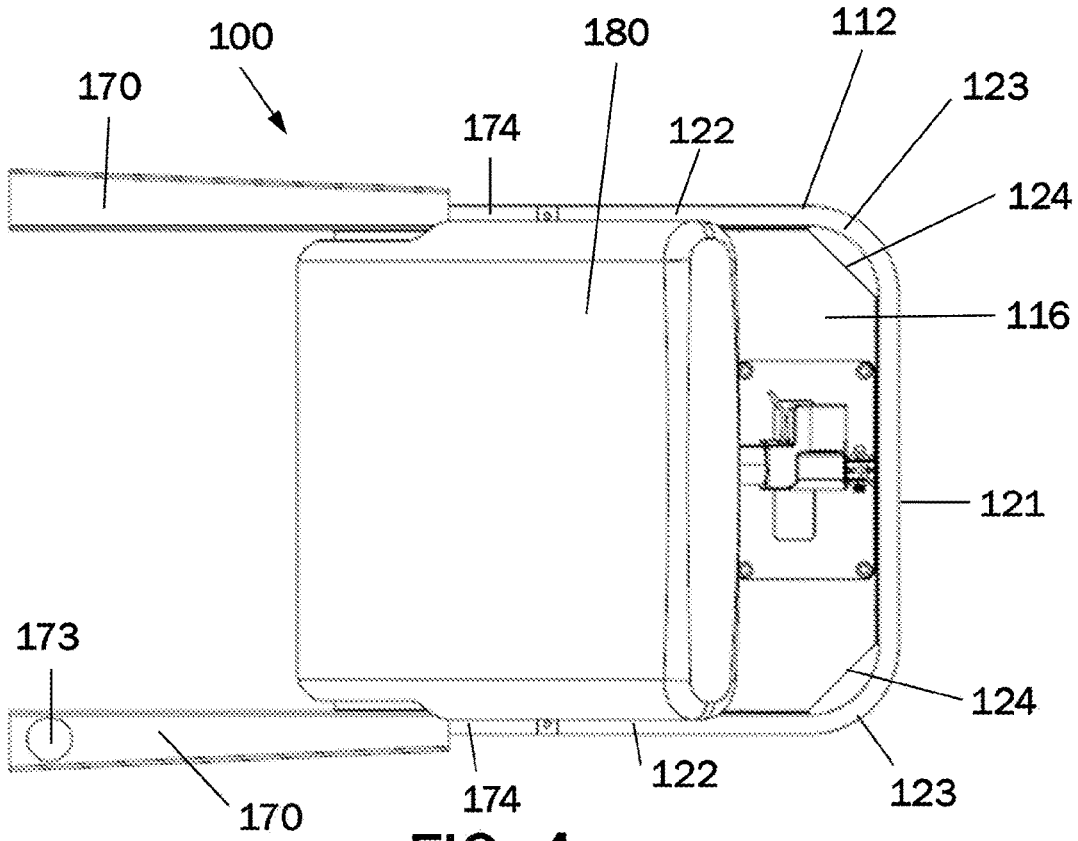
FIG. 4 is a top view of the pillow lifting system of FIG. 1.

FIG. 4 is a top view of the pillow lifting system 100 of FIG. 1. Referring to FIG. 4, the bottom frame 112 may include two side tubes 122 and an end tube 121 connected at corners 123. Corners 123 may be rounded. In the embodiment illustrated, the two side tubes 122, the end tube 121 and the corners 123 are all formed from a single continuous tube. The front frame 132 may include a similar structure with side tubes, an end tube and rounded corners. The bottom plate 116 may include chamfers 124 adjacent the corners 123. The front plate 136 may also include chamfers adjacent the corners of the front frame 132.

Figure 5:
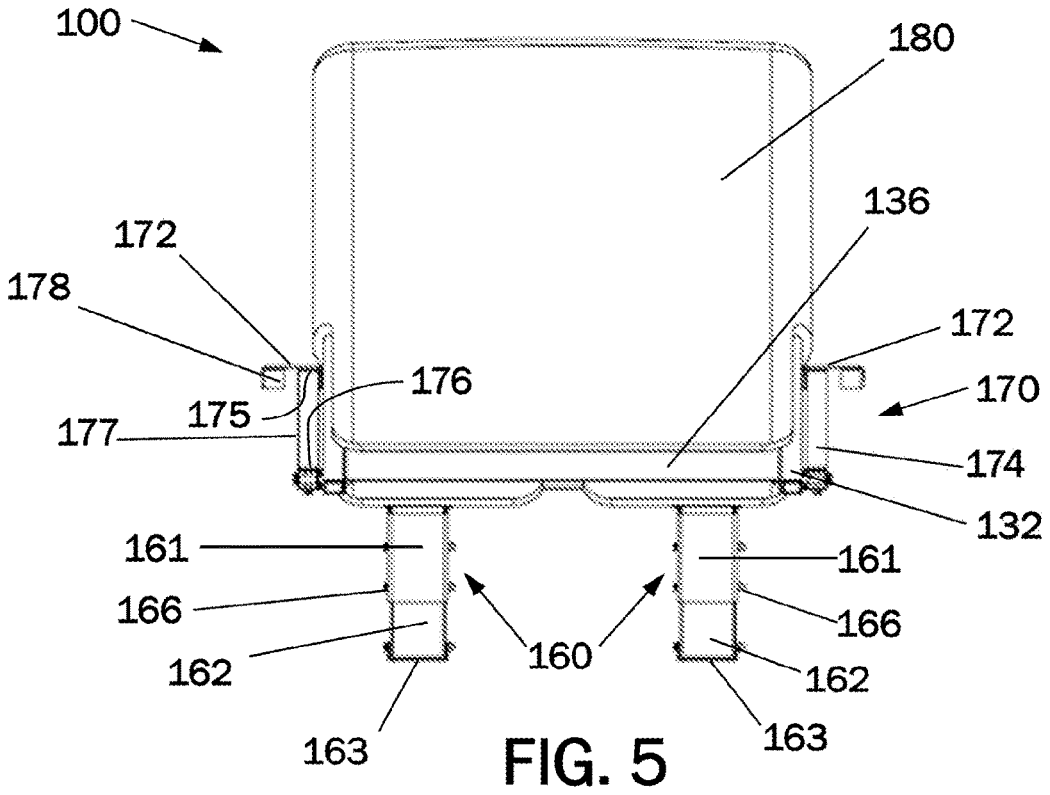
FIG. 5 is a front view of the pillow lifting system of FIG. 1.

FIG. 5 is a front view of the pillow lifting system 100 of FIG. 1. Referring to FIGS. 2, 3 and 5, each leg assembly 160 may include an upper leg 161, a lower leg 162, and a foot 164. The upper leg 161 may be joined to the base 110 at the closed end 113 of the bottom frame 112. In the embodiment illustrated, the upper leg 161 is joined to the end tube 121 of the bottom frame 112. In some embodiments, the upper leg 161 is pivotally connected to the base 110. This may allow the leg assembly 160 to be rotated out of the way so that the bed can be made without removing the unit.

The lower leg 162 is connected to the upper leg 161 and may overlap with the upper leg 161. The amount of overlap between the upper leg 161 and the lower leg 162 may be changed to alter the combined length of the upper leg 161 and lower leg 162 to increase or decrease the distance between the foot 164 and the base 110. In the embodiment illustrated, the lower leg 162 is narrower than the upper leg 161 to fit therein. The upper leg 161 and the lower leg 162 include pin holes 163 along each side. The leg assembly 160 may include pins 166 that are placed in the pin holes 163 through the upper leg 161 and the lower leg 162 to join the lower leg 162 to the upper leg 161 at a desired length. In other embodiments, the upper leg 161 and the lower leg 162 may have a telescoping configuration with a locking mechanism that has multiple locking positions.

The foot 164 is joined to the lower leg 162. The foot is configured to extend in the same direction as the base 110. The foot 164 may be pivotally connected to the lower leg 162. Pins 166 may also be used to join the foot 164 to the lower leg 162 and to join the upper leg 161 to the base 110.

Referring to FIG. 3, the combined height of the upper leg 161 and lower leg 162 may be set to match the thickness of the mattress 50 that the pillow lifting system 100 is going to be installed onto. Matching the combined height of the upper leg 161 and lower leg 162 to the thickness of the mattress 50 may allow the foot 164 to be inserted between the mattress 50 and the box spring 55, which may hold the pillow lifting system 100 in place relative to the mattress 50.

Referring to FIGS. 2 and 5, each arm assembly 170 may include a riser 174 and an arm rest 172. The riser 174 may include a riser upper bracket 175, a riser lower bracket 176, and riser tubes 177. The riser tubes 177 extend between the riser lower bracket 176 and the riser upper bracket 175 to support the riser upper bracket 175. The riser tubes 177 may be joined, such as by metallurgical bonding, to the riser lower bracket 176, the riser upper bracket 175, and to other riser tubes 177. The riser lower bracket 176 may couple to the base 110, such as to the bottom frame 112 adjacent the open end 114 of the bottom frame 112. The riser upper bracket 175 may couple to the arm rest 172 to support and hold the arm rest 172 in place. The arm rest 172 may extend outward from the riser 174 in the direction opposite the closed end 113 and the leg assemblies 160. One of the arm rests 172 may include a cup holder 173. In the embodiment illustrated, the cup holder 173 is a through hole extending through the arm rest 172.

Figure 6:
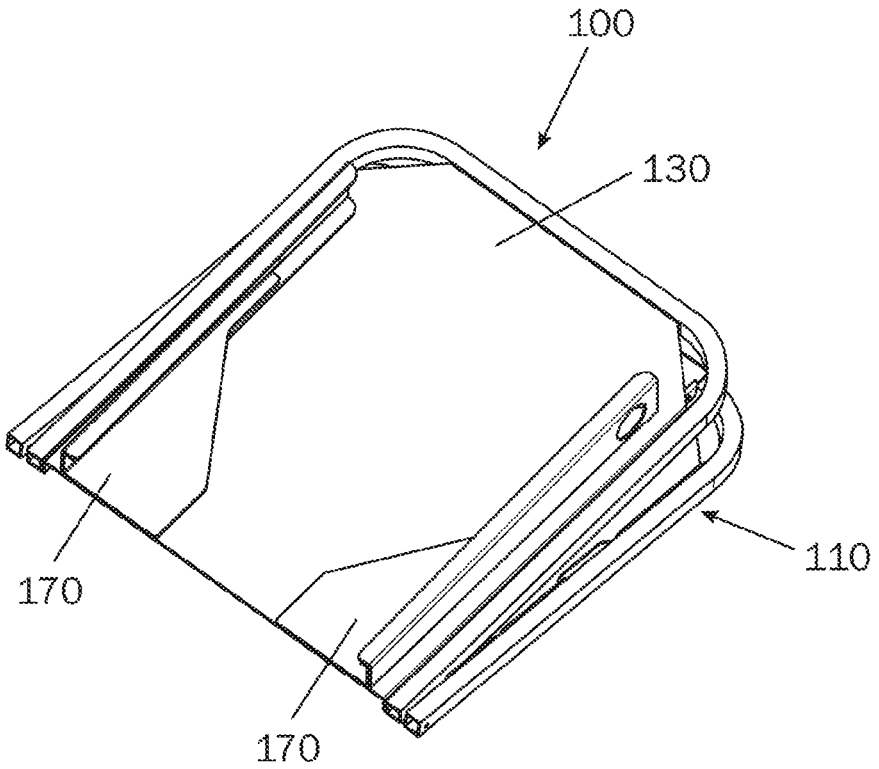
FIG. 6 is a perspective view of an embodiment of the pillow lifting system folded into a storage configuration.

The pillow lifting system 100 can be actuated from a flat lying position to vertical sitting position or can be folded flat for transport or storage as seen in FIG. 6, and can be set to any position there between. Referring to FIG. 3, in some embodiments, the angle 90 between the base 110 and the back rest 130 can be changed from a flat lying position of ten degrees to a vertical sitting position of eighty-five degrees and to any lying or sitting position there between. The actuator 150 rotates the back rest 130 relative to the base 110 and supports the back rest 130 in the position selected by a user.

Referring to FIGS. 1 and 2, the pillow lifting system 100 may also include a controller 190. The controller 190 may operate the actuator 150 and to position the back rest 130 relative to the base 110. In the embodiment illustrated, the controller 190 is wired to the actuator 150. In other embodiments, the controller 190 may be wirelessly connected to the actuator 150. The controller 150 may be mounted or removably mounted to the pillow lifting system 100, such as to the arm rest assembly 170 or to the back rest 130. The controller 150 may be mounted using a bracket of a removable fastener, such as a hook and loop fastener.

Figure 7:
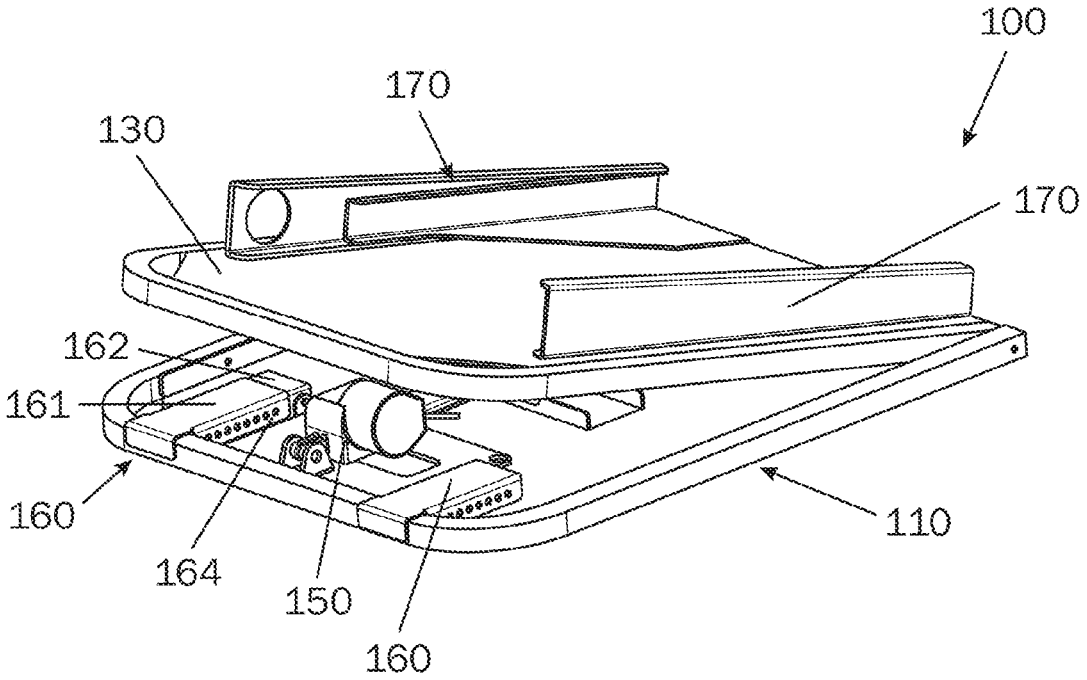
FIG. 7 is a perspective view of the pillow lifting system of FIG. 6 from a different viewpoint.

FIG. 6 is a perspective view of an embodiment of the pillow lifting system 100 folded into a storage configuration. FIG. 7 is a perspective view of the pillow lifting system 100 of FIG. 6 from a different viewpoint. Referring to FIGS. 6 and 7, the pillow lifting system 100 may be folded for storage when it is not in use. As shown, the actuator 150 may be set so that the back rest 130 is in its flattest position relative to the base 110. The foot 164 of each leg assembly 160 may be rotated parallel to the upper leg 161 and the lower leg 162. Each leg assembly 160 with the foot 164 folded against the upper leg 161 and the lower leg 162 can be rotated relative to the base so that the upper leg 161, the lower leg 162, and the foot 164 are parallel to and adjacent to the base 110. When stowed, each leg assembly 160 may be located between the base 110 and the back rest 130. The arm assemblies 170 may be detached and placed adjacent the back rest 130. Stowing the leg assemblies 160, removing the arm assemblies 170, and rotating the back rest 130 to its flattest position significantly reduces the footprint of the pillow lifting system 100. The reduced footprint may allow the pillow lifting system 100 to be stowed away into small spaces, such as in a closet or under a bed.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

What is claimed is:

1. A torso lifting apparatus comprising:

a base with a bottom frame coupled to a bottom plate with bottom brackets, the bottom frame having a U-shape including a closed end and an open end;

a backrest having a front frame coupled to a frame plate, the front frame having a U-shape including a closed end and an open end, wherein the front frame is narrower than the bottom frame and the open end of the front frame is pivotally connected within and adjacent to the open end of the bottom frame;

a pillow covering at least a portion of the backrest;

one or more arm rest assemblies, each comprising a riser having a first end and a second end, the first end of the riser affixed to the bottom frame adjacent to the open end of the bottom frame and the second end of the riser affixed to an arm rest extending outward from the riser at a second end of the riser;

an actuator wherein the backrest is pivotally coupled to the base and the actuator is configured to be operable to rotate the backrest from a horizontal position to a vertical sitting position which lifts a torso of a human from a supine position to a sitting position; and wherein the torso lifting apparatus is configured to be used on top of a mattress.

2. The torso lifting apparatus of claim 1, further comprising a joint between the base and the back rest enabling the backrest to rotate relative to the base.

3. The torso lifting apparatus of claim 1, wherein the pillow is connected to the backrest, and wherein the pillow covers all of the backrest.

4. The torso lifting apparatus of claim 1, further comprising one or more legs connected to the base wherein the one or more legs includes an upper leg, a lower leg and a foot.

5. The torso lifting apparatus of claim 1, further comprising a controller which operates the actuator to position the back rest relative to the base.

6. The torso lifting apparatus of claim 1, further comprising a hydraulic cylinder comprising a motor, a cylinder and rod wherein the motor moves the rod relative to the cylinder to lengthen or shorten the actuator causing the back rest to rotate relative to the base.

7. The torso lifting apparatus of claim 1, wherein the apparatus is manufactured from at least one of aluminum, plastic or mesh material.

8. The torso lifting apparatus of claim 1, wherein the apparatus is light weight ranging from 5 to 22 pounds.

9. A pillow lifting system comprising:

a base with a bottom frame coupled to a bottom plate with bottom brackets, the bottom frame having a U-shape including a closed end and an open end;

a backrest having a front frame coupled to a frame plate, the front frame having a U- shape including a closed end and an open end, wherein the front frame is narrower than the bottom frame and the open end of the front frame is pivotally connected within and adjacent to the open end of the bottom frame;

a pillow covering at least a portion of the backrest; one or more legs coupled to the closed end of the bottom frame; one or more arm rest assemblies, each comprising a riser having a first end and a second end, the first end of the riser affixed to the bottom frame adjacent to the open end of the bottom frame and the second end of the riser affixed to an arm rest extending outward from the riser at a second end of the riser; a linear actuator including a motor, a cylinder and a rod; and a controller to operate the actuator; wherein the backrest is pivotally coupled to the base and the actuator is configured to be operable to rotate the backrest from a horizontal position to a vertical sitting position which lifts a torso of a human from a supine position to a sitting position; and wherein, in a folded position, the one or more legs are located between the base and the backrest; and wherein the system is configured to be used on top of a mattress.

10. The pillow lifting system of claim 9, wherein the controller can be wireless or wired to the actuator.

11. The pillow lifting system of claim 9, wherein the one or more legs include an upper leg joined to the base, a lower leg configured to overlap with the upper leg, and a foot joined to the lower leg.

12. The pillow lifting system of claim 11, wherein the one or more legs can telescope and lock at multiple positions.

13. The pillow lifting system of claim 11, wherein the system is configured for sitting on the mattress and box spring wherein the length of the one or more legs is set to match the thickness of the mattress so that the foot can be inserted between the mattress and box spring to hold the pillow lifting system in place.

14. The pillow lifting system of claim 9, wherein the system is light weight ranging from 5 to 22 pounds.

15. A torso lifting apparatus comprising:

a base with a bottom frame coupled to a bottom plate with bottom brackets, the bottom frame having a U-shape including a closed end and an open end;

a backrest having a front frame coupled to a frame plate, the front frame having a U-shape including a closed end and an open end, wherein the front frame is narrower than the bottom frame and the open end of the front frame is pivotally connected within and adjacent to the open end of the bottom frame;

at least one leg coupled to a foot and the closed end of the bottom frame, wherein the at least one leg is adjustable in height to be matched with a thickness of a mattress, and wherein the foot is sized and dimensioned to be inserted between the mattress and the box spring to hold the apparatus in place relative to the mattress;

one or more arm rest assemblies, each comprising a riser having a first end and a second end, the first end of the riser affixed to the bottom frame adjacent to the open end of the bottom frame and the second end of the riser affixed to an arm rest extending outward from the riser at a second end of the riser; and an actuator wherein the backrest is pivotally coupled to the base and the actuator is configured to be operable to rotate the backrest from a horizontal position to a vertical sitting position which lifts a torso of a human from a supine position to a sitting position.

* * * * *